US010450094B2

(12) United States Patent
Lelie et al.

(10) Patent No.: US 10,450,094 B2
(45) Date of Patent: Oct. 22, 2019

(54) FILM WRAPPING MODULE FOR CONTAINERS AS A COMPONENT OF A PACKAGING MACHINE, AND METHOD THEREOF

(71) Applicant: KHS GmbH, Dortmund (DE)

(72) Inventors: Thomas Lelie, Kleve (DE); Stefan Wagner, Xanten (DE)

(73) Assignee: KHS GmbH, Dortmund (DE)

( * ) Notice: Subject to any disclaimer, the term of this patent is extended or adjusted under 35 U.S.C. 154(b) by 236 days.

(21) Appl. No.: 14/907,373

(22) PCT Filed: May 19, 2014

(86) PCT No.: PCT/EP2014/060219
§ 371 (c)(1),
(2) Date: Jan. 25, 2016

(87) PCT Pub. No.: WO2015/010804
PCT Pub. Date: Jan. 29, 2015

(65) Prior Publication Data

US 2016/0176552 A1 Jun. 23, 2016

(30) Foreign Application Priority Data

Jul. 24, 2013 (DE) ..... 10 2013 107 919
May 16, 2014 (DE) ..... 10 2014 106 905

(51) Int. Cl.

| | |
|---|---|
| ***B65B 41/04*** | (2006.01) |
| ***B65B 11/10*** | (2006.01) |
| ***B65B 41/14*** | (2006.01) |
| ***B65B 21/24*** | (2006.01) |
| *B65B 53/06* | (2006.01) |

(52) U.S. Cl.
CPC ..... *B65B 11/10* (2013.01); *B65B 21/245* (2013.01); *B65B 41/04* (2013.01); *B65B 41/14* (2013.01); *B65B 53/063* (2013.01)

(58) Field of Classification Search
CPC ..... B65B 11/10; B65B 41/04; B65B 65/00
USPC ..... 198/570, 579, 602, 619; 53/203, 204, 53/461
See application file for complete search history.

(56) References Cited

U.S. PATENT DOCUMENTS 3,791,100 A * 2/1974 Monaghan ..... B65B 11/10 53/210
5,065,856 A 11/1991 Reid
5,203,144 A 4/1993 Gambetti
5,203,146 A * 4/1993 Gambetti ..... B65B 11/10 53/210

(Continued)

FOREIGN PATENT DOCUMENTS

DE 23 31 193 1/1975
DE 41 26 212 2/1993

(Continued)

*Primary Examiner* — Gloria R Weeks
(74) *Attorney, Agent, or Firm* — Occhiuti & Rohlicek LLP

(57) ABSTRACT

A wrapping unit that wraps a container pack with a piece of film as it moves along a container-transport path includes a linear transporter having an electromagnetic linear drive. This linear transporter circulates movement elements in a common direction around a closed movement-path. Each of these movement elements has a gripping head arranged thereon.

8 Claims, 4 Drawing Sheets

(56) References Cited

U.S. PATENT DOCUMENTS

| | | | | |
|---|---|---|---|---|
| 5,463,846 | A * | 11/1995 | Gambetti | B65B 11/10 53/210 |
| 6,349,818 | B1 * | 2/2002 | Spatafora | B65B 19/10 198/805 |
| 6,474,041 | B1 * | 11/2002 | Gambetti | B65B 11/10 53/141 |
| 6,874,302 | B2 * | 4/2005 | Gambetti | B65B 11/10 53/210 |
| 6,964,147 | B2 * | 11/2005 | Gambetti | B65B 11/10 53/389.5 |
| 7,726,464 | B2 | 6/2010 | Cerf | |
| 8,109,384 | B2 * | 2/2012 | Pressler | B65G 17/24 198/459.7 |
| 8,458,991 | B2 * | 6/2013 | Kaestner | B65B 11/10 53/203 |
| 8,826,632 | B2 * | 9/2014 | Hastreiter | B65B 11/10 53/203 |
| 2003/0230941 | A1 | 12/2003 | Jacobs | |
| 2012/0117923 | A1 * | 5/2012 | Hastreiter | B65B 11/10 53/461 |
| 2014/0311103 | A1 * | 10/2014 | Nitsch | B65B 17/02 53/543 |

FOREIGN PATENT DOCUMENTS

| | | |
|---|---|---|
| DE | 10 2006 037 105 | 2/2008 |
| DE | 10 2009 025 824 | 11/2010 |
| DE | 10 2009 044 271 | 4/2011 |
| DE | 10 2011 081 705 | 2/2013 |
| EP | 0 764 584 | 3/1997 |
| EP | 2 096 039 | 9/2009 |
| EP | 2 500 296 | 9/2012 |

* cited by examiner

FILM WRAPPING MODULE FOR CONTAINERS AS A COMPONENT OF A PACKAGING MACHINE, AND METHOD THEREOF

RELATED APPLICATIONS

This is the national stage under 35 USC 371 of international application PCT/EP2014/060219, filed on May 19, 2014, which claims the benefit of the Jul. 24, 2013 priority date of German application DE 102013107919.9 and the benefit of the May 16, 2014 priority date of German application DE 102014106905.6, the contents of both of which are incorporated herein by reference.

FIELD OF INVENTION

The invention relates to container processing, and in particular, to wrapping containers along a transport path.

BACKGROUND

It is known to combine containers into container packs, to wrap those container packs with a plastic film, and to then shrink the plastic film in a shrink tunnel. Among the tasks to be carried out in the foregoing procedure is that of wrapping the container pack loosely with plastic film before it enters a shrink tunnel. A wrapping module carries out this task.

In known devices, the wrapping module receives a film segment and places it around the container pack as the container pack moves along a transport plane. In most cases, it receives a film segment that has been fed from below the transport plane. A first end of this film segment is first conveyed through a gap between two conveyors below the bottom end of the container pack. The entire container pack rests on this first end, some of which may protrude beyond the container pack. A carrier then conveys the remainder of the film segment from behind the container pack and around to a leading face of the container pack, thus wrapping the container pack at least in some regions thereof.

In order to do this, the carrier, with the film segment held, overtakes the container pack in the transport direction and guides the second end of the film segment towards the first end of the film segment. In order to allow the carrier to overtake, the container pack slows down. This reduces throughput.

SUMMARY

In one embodiment, the invention features a wrapping unit having a linear transporter that defines a closed movement-path along which movement elements circulate in a common direction. Each movement element has one or more associated gripping elements that are controllable independently of one another. In some embodiments, the gripping elements are bar-shaped elements that extend transversely to the transport direction at least along a sub-section of an outward run of the movement path.

Although the movement elements circulate substantially in a common direction, it is still possible to move a movement element individually and briefly in a direction other than the common direction when doing so would be useful. For example, this may be useful to vary a distance between movement elements.

The linear transporter ideally has a closed movement-path, on which the individual movement elements that circulate are arranged. The movement path has first and second linearly-oriented sections, which are referred to herein as an "outward run" and a "return run." Between the outward run and the return run are first and second deflection-sections. Together, these four sections form the closed movement path.

In some embodiments, the outward run and the return run have curved or obliquely oriented sub-sections. These permit the movement elements to have more degrees of freedom in their motion. This can be used, for example, to compensate for height differences or to cause motion in the horizontal direction.

The movement elements can be controlled individually independently of each other. This means that different movement elements can have different velocities. In operation, movement elements will typically move at the same velocity. However, there will be times when the movement element's velocity can change, either in magnitude or direction. This includes briefly reversing motion of the movement element for short periods.

Movement elements can be actuated to move at an adjusted speed, or to slow down during handover of the film segments and then accelerated. This permits a gentle handover of the film segments along an acceleration section of the movement path.

An advantage of having movement elements with individually controllable velocities is that only a very small number of movement elements will actually be required to process a particular rate of container flow. This is because movement elements moving along the return run can move faster than the movement elements moving along the outward run.

In some embodiments, the movement path has a lock for permitting removal of movement elements that are either not required for operation or that otherwise need to be removed for maintenance and inspection. This lock can also be used to permit insertion of additional movement elements or for reinsertion of movement elements that are being returned from maintenance and inspection.

In some embodiments, the linear transporter is an electromagnetic track, and the movement elements circulate along the track without the need for gears and in a directly controlled manner that permits them to be directly actuated. A controller, in this case, can be connected to an interface of the movement path.

Among these embodiments are those in which the linear transporter is an electromagnetic direct drive. In such embodiments, the actual driving occurs as a result of a dynamically controllable electromagnetic field along a rail or track. This permits a magnetic force resulting from a magnetic field to move a permanent magnet arranged on the movement element in a controlled manner.

Yet another advantage of having individually controllable movement elements is that the movement elements can be accelerated to overtake the container pack. This permits the container packs to be transported at the maximum possible transport speed, thus increasing throughput.

In some embodiments, the gripping elements execute any movement relative to both the linear transporter and to the movement element itself. Such gripper elements can be actuated with many degrees of freedom. Preferably, the controller that controls the movement elements also controls the gripping elements.

The gripping elements thus transport film segments securely as the movement elements circulate on the movement path. In some embodiments, the movement path is a rail.

The wrapping unit places the film segments below the container packs. One end of the film segment goes under the container pack and the other end overtakes the container pack so that it too can be placed under the container pack on the opposite side. The rest of the film segment then drapes over the container pack.

One advantage of the method described herein is that it is only the gripping element that has to hold the film segment. Another advantage is that the movement element can be accelerated so as to overtake the container pack. This also accelerates the gripping element so that it pulls away from the container pack in the running direction. As a result, the gripping element, like the movement element, also overtakes the container pack.

An alternative embodiment features a linear transporter arranged to the side of the transport plane with a movement path section below the transport plane. In this embodiment, there is a handover section at which film segments are handed over to the linear transporter and transported in the direction of the transport plane.

Among these embodiments are those in which an adjoining movement path section, referred to herein as an "ascending section," climbs away from the transport plane. The ascending section can be either vertical or inclined. In some of these embodiments, the ascending section merges into an end section of an outward run that runs parallel to the transport plane and adjoins a deflection section. It is here that the return run starts. In this case, the next section is a descending section that brings a second end of the film segment under the container pack.

Preferably, the descending section is configured in a manner identical to the ascending section. However, this need not be the case. In some embodiments, the ascending section and the descending section are not identical. This difference is possible because the movement elements are independently actuatable and can therefore be actuated differently. As a result, it is possible to avoid having a predefined division, as required by rigidly arranged carriers.

The return run starts at the first deflection section and extends to the second deflection section, which adjoins the handover section. An end section of the return run runs parallel to and below the transport plane between the descending section and the second deflection section. As they traverse the end section, movement elements can be accelerated so that they will be ready for re-use with minimal delay. In some embodiments, the outward run and the return run are identical. However, this is not required. In other embodiments, the outward run and the return run are of different design.

In some embodiments, the gripping element includes a bar-shaped element that is movable relative to the movement elements. As a result, the bar-shaped element can assume, at any position along the movement path, any orientation relative to the movement elements and relative to the transport path. Among these embodiments are those in which the bar-shaped element extends transverse to the transport path to an extent that is sufficient to span the transport path. This enables the bar-shaped element to support the entire width of a film segment.

In some embodiments, the bar-shaped element moves into a different orientation as the movement element crosses over onto the return path. Since it no longer has to support a wide film segment as it traverses the return path, the bar-shaped element can instead be oriented relative to the transport path in such a way as to require less space in the transverse direction. However, this is not always the case. In other embodiments, the bar-shaped element is arranged rigidly or immovably on the movement element.

A wrapping unit as described herein improves throughput in at least two ways. First, the container packs can be spaced more closely together as they enter the wrapping module. This is possible since a fixed division, which was originally required, has been rendered obsolete by having gripping elements that can be accelerated at the outlet of the wrapping unit. As a result, successive container packs can enter the wrapping unit as closely together as desired.

Second, as a result of the ability to individually control the movement elements, it is now possible to have two or more container packs in different stages of being wrapped within the wrapping device at the same time.

In some embodiments, each gripping element includes a bar-shaped element that is assigned to a movement element.

In other embodiments, the gripping element grips a film segment mechanically at corner regions thereof. One example of mechanical gripping is gripping by suction.

In some embodiments, a single linear transporter is arranged on just one side of the transport path. However, in other embodiments, there is a linear transporter arranged on each side of the transport plane. This permits a pair of movement elements to move together at the same speed on parallel movement paths.

Among these embodiments are those in which these paired movement elements move at the same speed along an outward run and a section of the return run adjoining the first deflection section. Such embodiments are able to have gripping elements moving on parallel movement paths cooperate to guide a film segment by its opposed corner regions.

This feature permits the gap in the transport plane through which a film segment passes to be just wide enough to accommodate the dimension of the film segment since the gripper elements will be gripping its corner regions from outside the transport path of the film segment.

Yet another advantage of the foregoing configuration with two parallel movement paths is that, with gripping elements also being movable relative to each other and relative to the movement elements, it becomes a simple matter to hold the film taut during transport, thus avoiding movement of the film during transport thereof.

The wrapping unit described herein is able to wrap a plurality of container packs arranged one on top of the other with a film segment. However, it can also wrap individual container packs.

In some embodiments, the movement path delivers, to the movement elements, energy required to move the movement elements. However, it is also possible for the movement element to have an energy store that must at times be charged. To facilitate removal and insertion of a movement element, the movement path includes an optional lock. As a result, it is possible to continue operating the wrapping unit even though some movement elements have been removed for maintenance, checking, repair, or charging.

In one aspect, the apparatus includes a wrapping unit that wraps a container pack with a piece of film as it moves along a container-transport path. Such a wrapping unit includes a linear transporter having an electromagnetic linear drive. This linear transporter circulates movement elements in a common direction around a closed movement-path. Each of these movement elements has a gripping head arranged thereon.

In some embodiments, the closed movement-path comprises an outward run and a return run between which the deflection sections are arranged.

In other embodiments, the gripping head comprises a guide rod having a bar-shaped element that extends transversely to the closed movement-path at least along a subsection of an outward run thereof.

In yet other embodiments, the gripping head is freely movable relative to both the linear transporter and the movement element.

Additional embodiments include those in which each movement element comprises an additional gripping head, with the gripping heads on a particular movement element being controllable independently of one another.

Further embodiments are those in which the movement elements are individually controllable along the closed movement-path so that, in operation, different movement elements move at different velocities. Velocity in this context refers to both magnitude and direction.

In other embodiments, the closed movement-path is to the side of the container-transport path. Among these embodiments are those in which the closed movement-path, which runs parallel to the transport plane, has an outward run having an end section, and the handover section that ascends from below a transport plane and merges into the end section. The end section is adjoined by the first deflection-section that is adjoined by a descending movement section that is guided from above the transport plane to below the transport plane and that merges into an end section of a return run running parallel to the transport plane. The second deflection-section adjoins this end section. Meanwhile, the handover section adjoins this second deflection-section. In some of these embodiments, the first and second deflection-sections have the same inclination, however, in others, they do not.

In some embodiments, the closed movement-path has an outward run and a return run that are separated by an adjustable distance.

In other embodiments, the closed movement-path has an adjustable height above the transport plane. Raising and lowering the closed movement-path adjusts this adjustable height.

Other embodiments include those in which the movement element comprises a driven gripping head, a guide rod, and a coupling element connecting the gripping head and the guide rod.

In another aspect, the invention includes causing a linear transporter configured as an electromagnetic direct drive to circulate movement elements in a common direction around a closed movement-path, and, using a gripping head on a first movement element, gripping a first piece of film that is to be wrapped around a first container pack moving along a container-transport path, and wrapping the first container with the first piece of film.

Some practices of this method include using a gripping head on a second movement element to grip a second piece of film that is to be wrapped around a second container pack moving along the container-transport path, and wrapping the second container with the second piece of film concurrently with the wrapping of the first container.

A container pack typically comprises containers. As used herein, "containers" include bottles, cans, tubes or pouches, whether made of metal, glass and/or plastic. These include PET bottles and other packaging means, including those that are suitable for being filled with liquid or viscous products and for holding foodstuffs. "Containers" is also used recursively to indicate containers that have already been combined into groups, such as multipacks or other container packs.

These and other features of the invention will be apparent from the following detailed description and the accompanying figures, in which:

DETAILED DESCRIPTION

Figure 1:
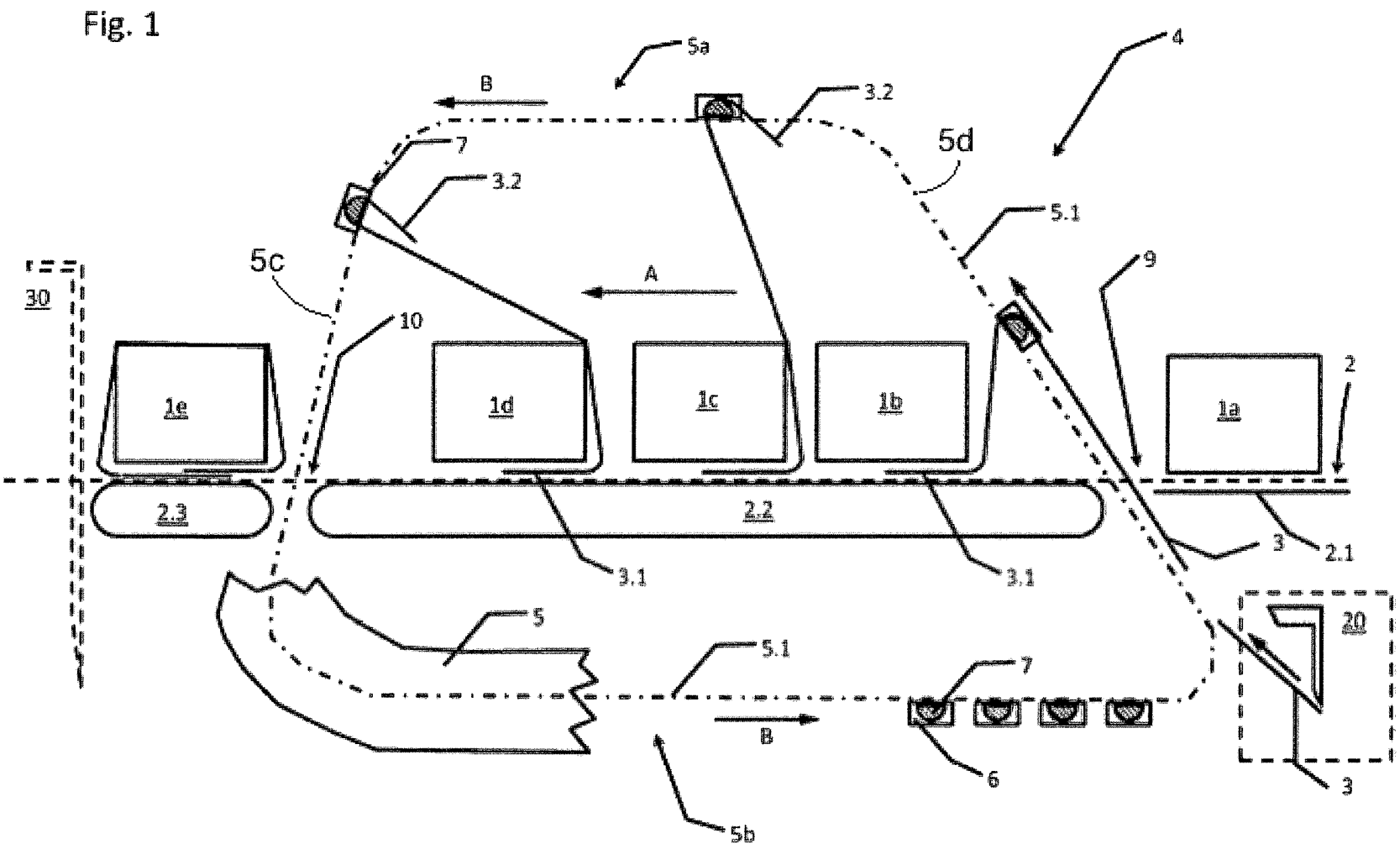
FIG. 1 is a side view of a wrapping unit.

FIG. 1 shows a transport unit 2 that includes an inlet conveyor 2.1, a wrapping conveyor 2.2, and an outlet conveyor 2.3 that adjoins a shrink tunnel 30. A wrapping unit 4 is arranged along the transport unit 2. The wrapping unit 4 wraps container packs 1 with film segments 3 as the container packs 1 move along a transport plane defined by the transport unit 2.

A supply-and-film-cutting unit 20 cuts incoming film into film segments 3, each of which has a front end 3.1 and a rear end 3.2. The supply-and-film-cutting unit 20 provides these film segments 3 to the wrapping unit 4.

A gripping-and-holding element guides each film segment 3 through a first gap 9 located between the inlet conveyor 2.1 and the wrapping conveyor 2.2 so that the film segment 3 crosses into the transport plane just in front of a container pack 1 to be wrapped. In a subsequent downward or return movement, which occurs at the opposite end of the wrapping conveyor 2.2, the gripping-and-holding element passes through a second gap 10 at the end of the wrapping conveyor 2.2.

The wrapping unit 4 includes a linear transporter 5 having a closed movement-path 5.1 that has an outward run 5*a* and a return run 5*b*. Between the outward run 5*a* and the return run 5*b* are first and second deflection-sections 5*c*, 5*d*. In one embodiment, the linear transporter 5 is an electromagnetic drive that actuates and moves movement elements 6 independently of each other. In operation, these movement elements 6 circulate in a common direction B along this closed movement-path 5.1.

In some embodiments, these movement elements 6 are runners, and in others, the movement elements 6 are movers. In either case, each movement element 6 includes a gripping element 7. In the embodiment shown in FIG. 1, the gripping element is a bar-shaped guide rod on which the film segment rests loosely. Each guide rod has a circular, semi-circular, or polygonal cross-section and extends transversely to a transport path of the container packs 1.

FIG. 1 shows a first container pack 1*a* on the inlet conveyor 2.1, second, third, and fourth container packs 1*b*, 1*c*, 1*d* located on the wrapping conveyor 2.2 and downstream of the first gap 9, and a fifth container pack 1*e* on the outlet conveyor 2.3. All the container packs 1*a*-1*d* are of comparable size. Each container pack 1*a*-1*d* stands on a front end 3.1 of a corresponding film segment 3.

Meanwhile, the movement elements 6, and thus the gripping elements 7, move relative to their corresponding container packs so that the rear end 3.2 of a corresponding film segment 3, just before the end of the wrapping step, protrudes only as far as absolutely necessary for it still to be securely held. As a movement element 6 approaches the end of the wrapping conveyor 2.2, it executes a downward movement. FIG. 1 shows one movement element 6 caught in the middle of such a downward movement as it wraps a film segment 3 around the fourth container pack 1*d*. The movement element 6 travels downward past the position shown in FIG. 1 and past the fourth container pack 1*d*, ultimately releasing the rear end 3.2 of the film segment 3 so that the fourth container pack 1*d* can run over it, as the fifth container pack 1*e* has already done.

Because the linear transporter 5 can independently control each movement element, only a few movement elements 6 need to be provided in a waiting position at the end of the return run 5*b*. This is because it is possible to accelerate a movement element 6 back from the end of the outward run 5*a* to the end of the return run 5*b*. In principle, a backward movement of the movement element 6 is also possible, but this is not useful during normal operation.

Figure 2:
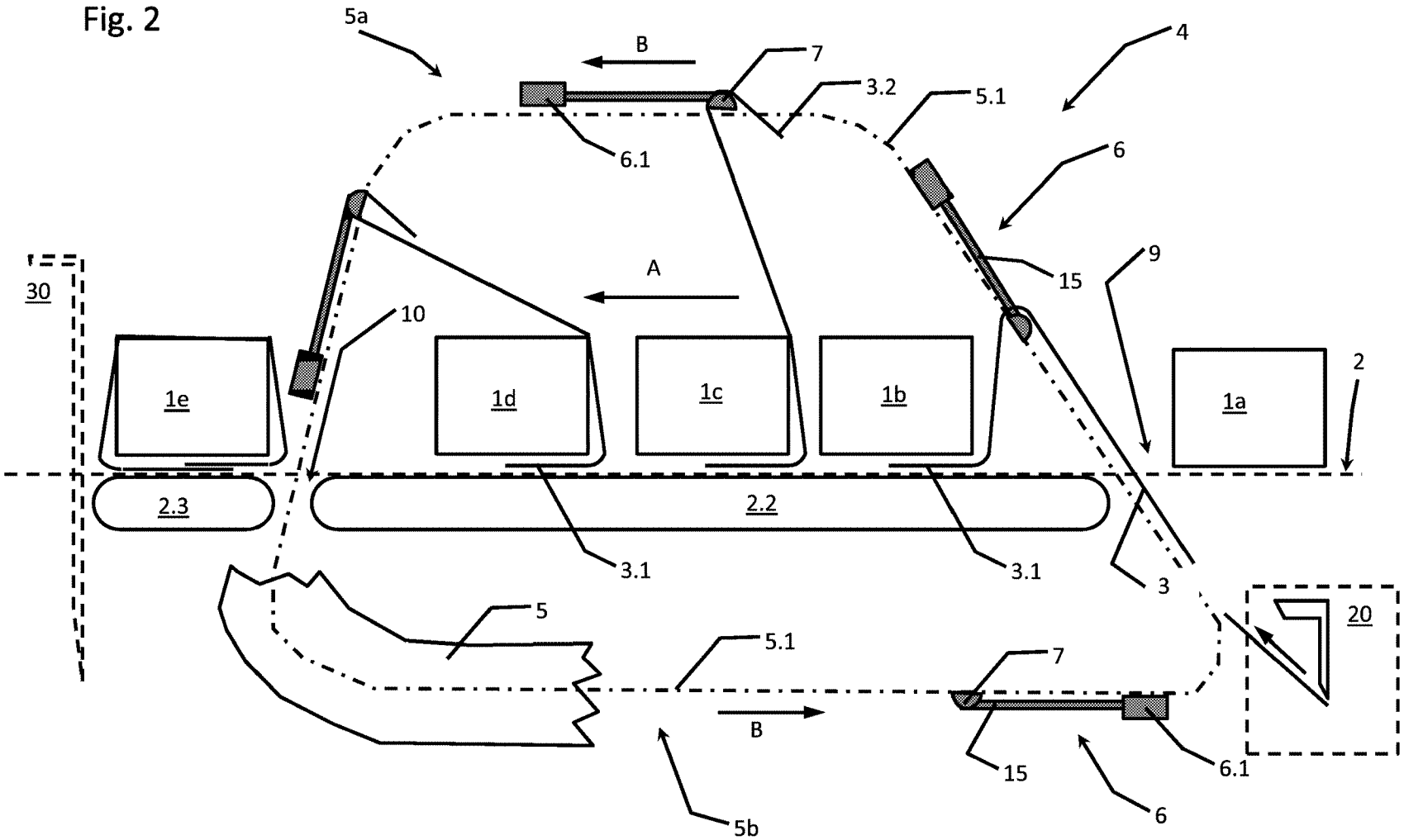
FIG. 2 is an alternative embodiment of the wrapping unit shown in FIG. 1.

FIG. 2 is comparable with FIG. 1 but with different movement elements 6. In FIG. 1, each movement element 6 includes a driven gripping head 6.1 coupled to a guide rod 7 via a coupling element 15. The gripping head 6.1 grips a film segment 3 from the front or from the front and side. The rear end 3.2 of a film segment 3 rests loosely over the guide rod 7.

Figure 3:
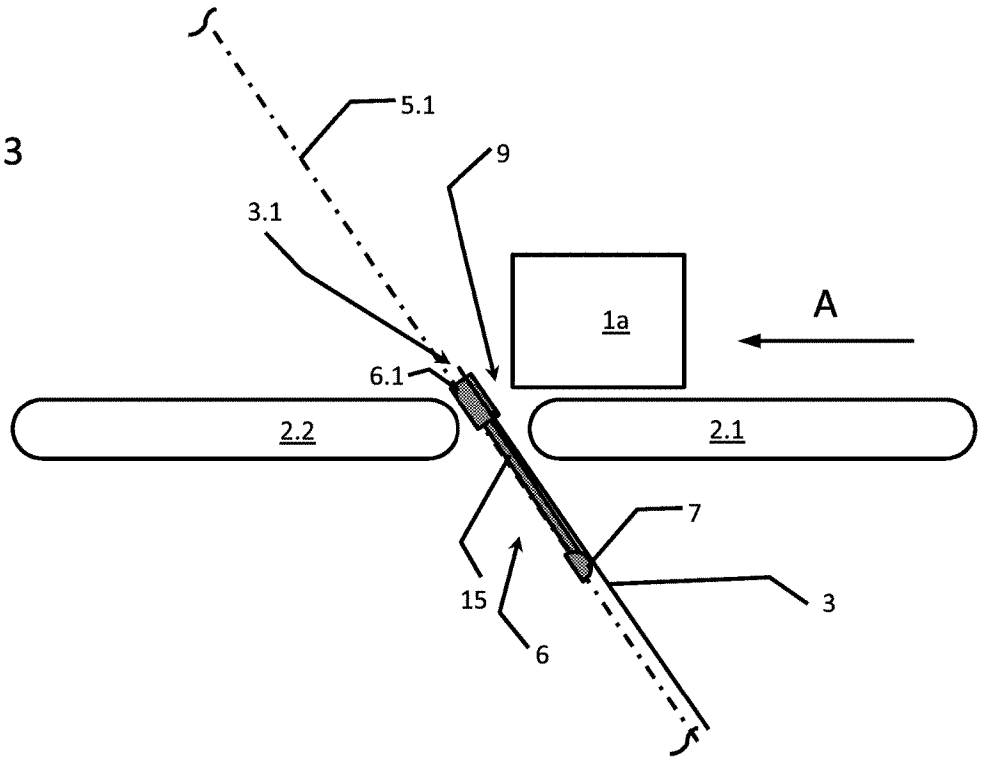
FIG. 3 shows the feeding of the film shortly before it makes contact with the container pack according to FIG. 2, and FIGS. 4*a* and 4*b* show the position of the film and of the container pack immediately after the container pack has travelled over the film in the embodiment according to FIG. 2.

As can be seen in FIG. 3, by actively guiding the front end 3.1, it becomes possible to control the extent to which a container pack 1*a* overlays a front end 3.1 of the film segment 3 as the inlet conveyor 2.1 advances it. The release of the film segment 3 from the gripping head 6.1 can therefore take place simultaneously since the container pack 1*a* pulls the film segment 3 out of the opening or just-opened grippers of the gripping head 6.1.

The free front-end 3.1 can thus always be selected to be long enough to rest securely on the outward run of the wrapping conveyor 2.2 but to avoid passing a front deflection-section and to avoid being conveyed below the transport plane.

Figure 4B:
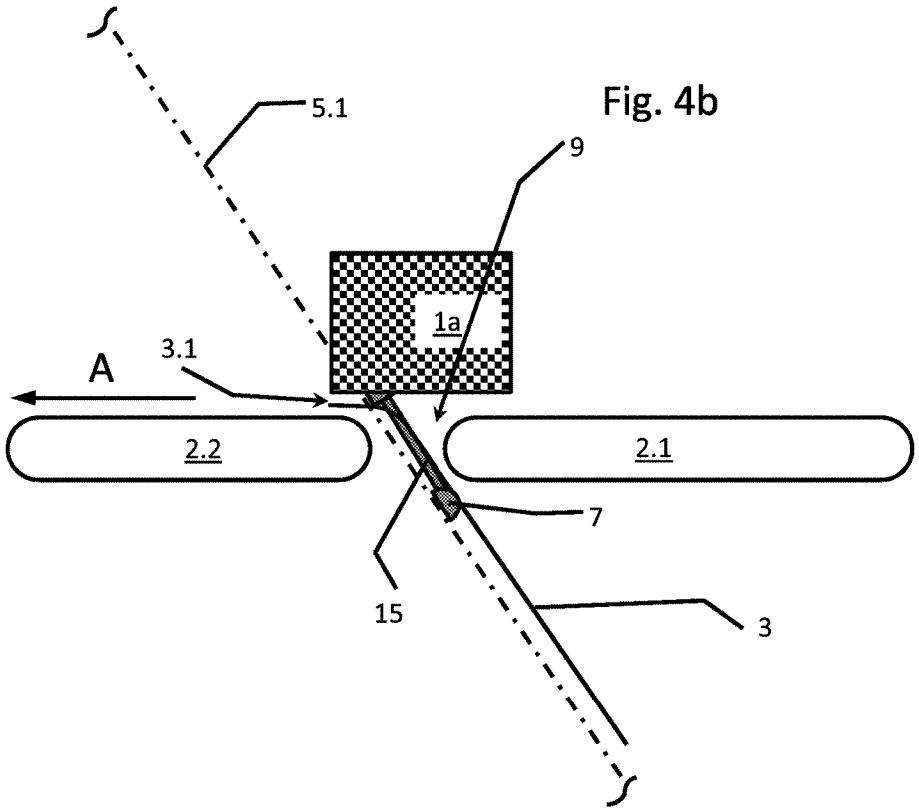

FIG. 4*b* shows the instant at which the film segment 3 is released from the gripping head 6.1. A malfunction is thus also avoided, as shown in FIG. 4*b*, even with a relatively wide first gap 9.

Figure 4A:
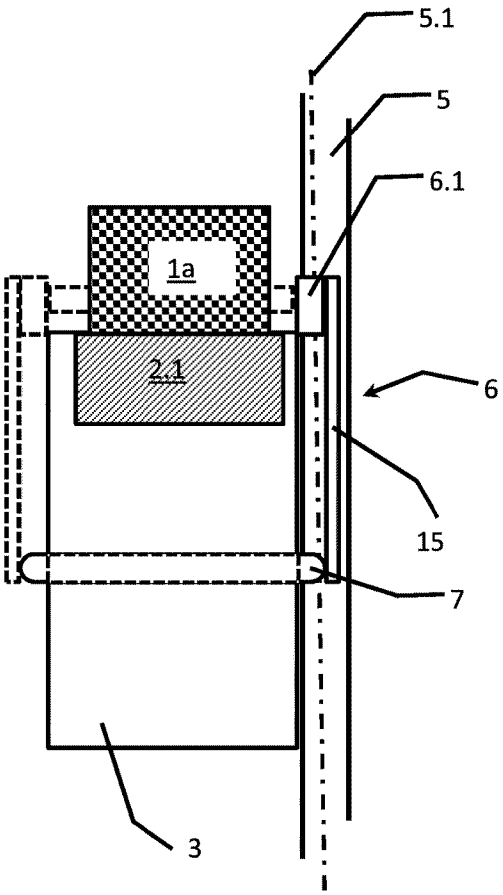

FIG. 4*a* shows the configuration of FIG. 4*b* in a side view as seen from the transport direction. It is usually sufficient if the driven gripping head 6.1, the guide rod 7 and the coupling element 15 are provided on just one side.

The coupling element 15 is mounted on the gripping head 6.1 in a suitable articulated manner and is guided in the region of the linear transporter 5. A mounting and/or motor drive on both sides may be advantageous, depending on the desired output and load situation.

Because of the flexibility with which movement elements 6 can be moved, it becomes possible to process a much larger range of product sizes using the same wrapping unit.

This flexibility in processing different product sizes can be even further increased by providing a height adjustment or change in height of a running path. In this case, it is useful to provide a vertical course of the movement path or of the linear conveyor in the region of the first and second gaps 9, 10.

In the embodiment shown in FIG. 1, the wrapping unit 4 is part of a packaging machine that includes a shrink tunnel 30 for shrinking the film segments 3 onto the container packs 1*a*-1*e*. In some embodiments, a stacking unit for placing container packs one on top of the other is installed upstream of the wrapping unit 4.

Having described the invention, and a preferred embodiment thereof, what is new, and secured by letters patent is:

The invention claimed is:

1. An apparatus for concurrently wrapping container packs along a container-transport path with film, wherein each container pack comprises a plurality of containers, wherein said apparatus comprises a wrapping unit, said wrapping unit comprising an electromagnetic direct drive and movement elements, wherein said electromagnetic linear drive has a closed movement path beside said container transport path, wherein said movement elements circulate in a common direction along said closed movement path, wherein said movement elements are individually controllable along said closed movement path, wherein said movement elements comprise first and second movement elements that wrap corresponding first and second container packs such that said first and second movement elements wrap their corresponding container packs concurrently, whereby said first and second container packs are transported by said container transport path at the same time while said first and second container packs are being wrapped by said first and second movement elements, wherein, in operation, different movement elements move at different velocities, wherein each movement element comprises a gripping head arranged thereon, wherein said closed movement-path comprises an outward run having an end section, and a handover section that ascends from below a transport plane and merges into said end section, wherein said closed-movement path runs parallel to said transport plane, wherein said end section is adjoined by a first deflection region that is adjoined by a descending movement section that is guided from above said transport plane to below said transport plane and that merges into an end section of a return run running parallel to said transport plane, said end section being adjoined by a second deflection region that is adjoined by said handover section, and wherein said first and second deflection regions have the same inclination.

2. The apparatus, claim 1, wherein said gripping head comprises a guide rod, wherein said guide rod comprises a bar-shaped element that extends transversely to said closed movement-path at least along a sub-section of an outward run thereof.

3. The apparatus of claim 1, wherein each movement element comprises a gripping-head set that includes said gripping head, and wherein said gripping head is controllable independently of any other gripping head in said gripping-head set.

4. The apparatus of claim 1, wherein said outward run and a return run are separated by an adjustable distance.

5. The apparatus claim 1, wherein said closed movement path has an adjustable height above said transport plane, and wherein raising and lowering said closed movement path adjusts said adjustable height.

6. The apparatus claim 1, wherein said movement element comprises a driven gripping head, a guide rod, and a coupling element connecting said gripping head and said guide rod.

7. The apparatus of claim 1, wherein said closed movement-path comprises an outward run and a return run, and wherein plural movement elements move along said outward run concurrently.

8. A method comprising providing container packs to be wrapped, each container pack comprising containers, and wrapping two or more container packs at the same time, wherein wrapping two or more container packs at the same time comprises individually controlling velocities of movement elements of an electromagnetic direct drive as said movement elements circulate in a common direction around a closed movement path, using a gripping head on a first movement element, gripping a first piece of film that is to be wrapped around a first container pack moving along a container-transport path, and wrapping said first container pack with said first piece of film, using a gripping head on a second movement element, gripping a second piece of film that is to be wrapped around a second container pack moving along said container-transport path, and wrapping said second container pack with said second piece of film concurrently with wrapping said first container pack.

* * * * *